US005309335A

United States Patent [19]

Tryon

[11] Patent Number: 5,309,335

[45] Date of Patent: May 3, 1994

[54] LIGHTING SYSTEM

[75] Inventor: John F. Tryon, Houston, Tex.

[73] Assignee: Shell Oil Company, Houston, Tex.

[21] Appl. No.: 985,777

[22] Filed: Dec. 4, 1992

[51] Int. Cl.[5] ..... F21S 1/02

[52] U.S. Cl. ..... 362/152; 362/151; 362/222; 362/223

[58] Field of Search ..... 362/217, 219, 223, 224, 362/222, 145, 152, 151

[56] References Cited

U.S. PATENT DOCUMENTS

| | | | |
|---|---|---|---|
| 2,337,685 | 12/1943 | Schepmoes . | |
| 2,643,328 | 6/1953 | Elmendorf | 362/224 |
| 3,211,904 | 10/1965 | Schwenkler | 362/224 |
| 3,428,799 | 2/1969 | Bassani | 362/219 |
| 3,675,006 | 7/1972 | Zagel et al. . | |
| 4,287,555 | 9/1981 | Stilling . | |
| 4,533,981 | 8/1991 | Radek . | |
| 5,020,252 | 6/1991 | De Boef . | |

*Primary Examiner*—Carroll B. Dority
*Attorney, Agent, or Firm*—Timothy J. Hadlock

[57] ABSTRACT

The invention includes a lens assembly for use in a lighting system including (a) an elongated translucent lens; (b) tracks for slidably receiving the lens; (c) means for securing the lens at one point thereby allowing thermal expansion and contraction of the elongated translucent lens along the tracks; and (d) means for receiving ends of the elongated translucent lens during expansion and contraction. The invention also includes a light box corner section attached to the corner of a raised canopy or roof including (a) a top assembly in an L-shaped configuration attached to the ceiling of the raised canopy; (b) a bottom panel having an L-shaped configuration attached to the top assembly; and (c) a corner section elongated translucent lens secured between at least a portion of the outer edges of said top assembly and bottom panel.

19 Claims, 3 Drawing Sheets

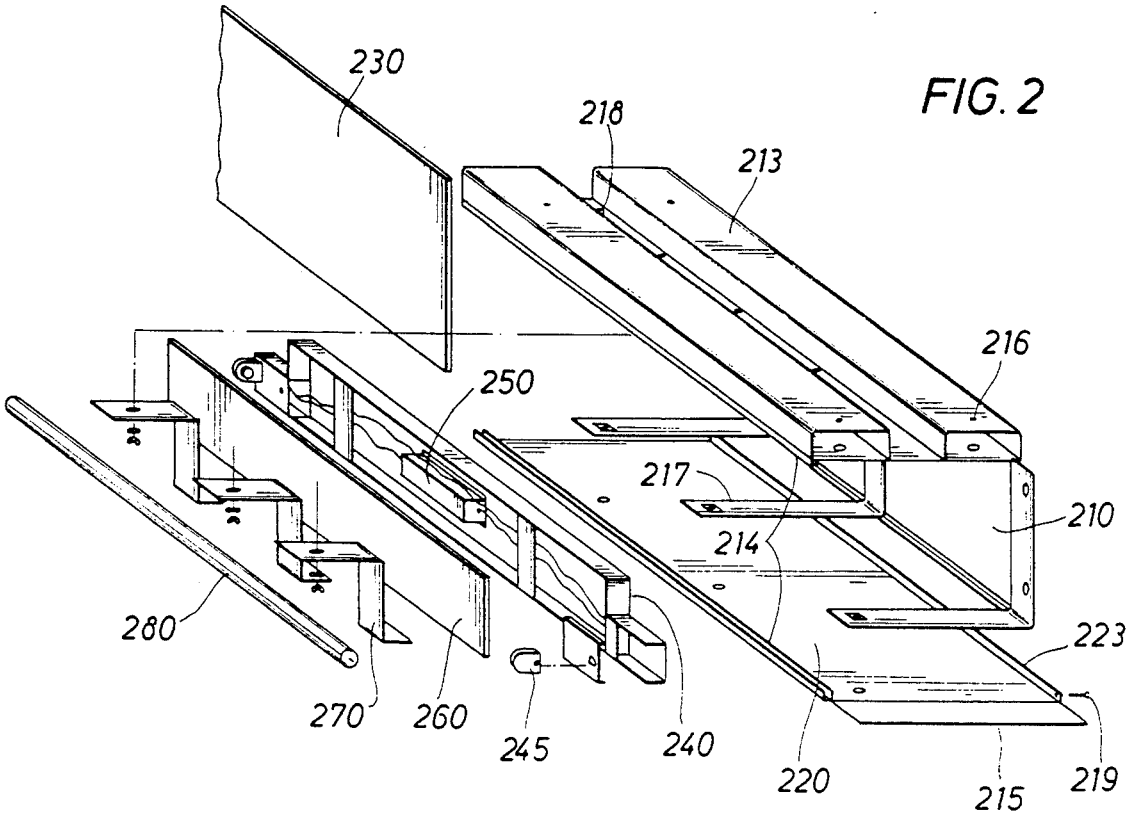
FIG. 2
FIG. 7
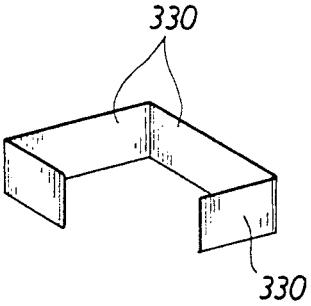
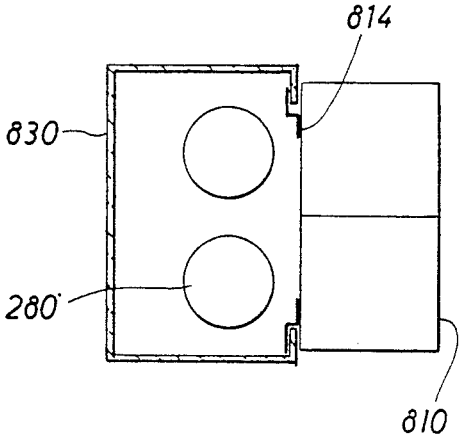
FIG. 8

FIG. 9
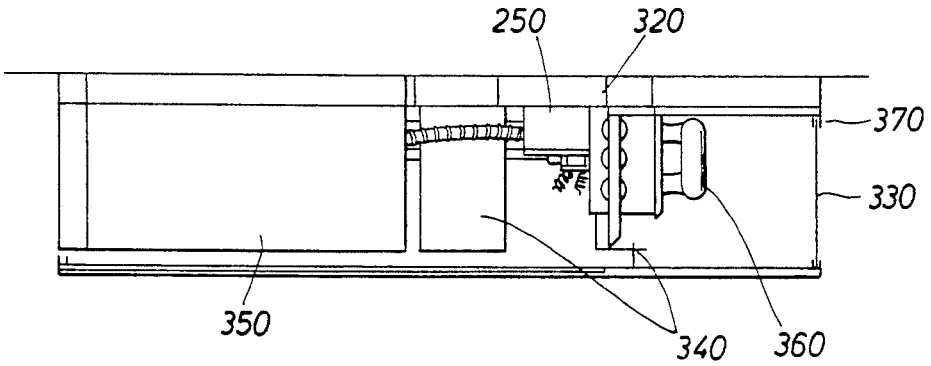
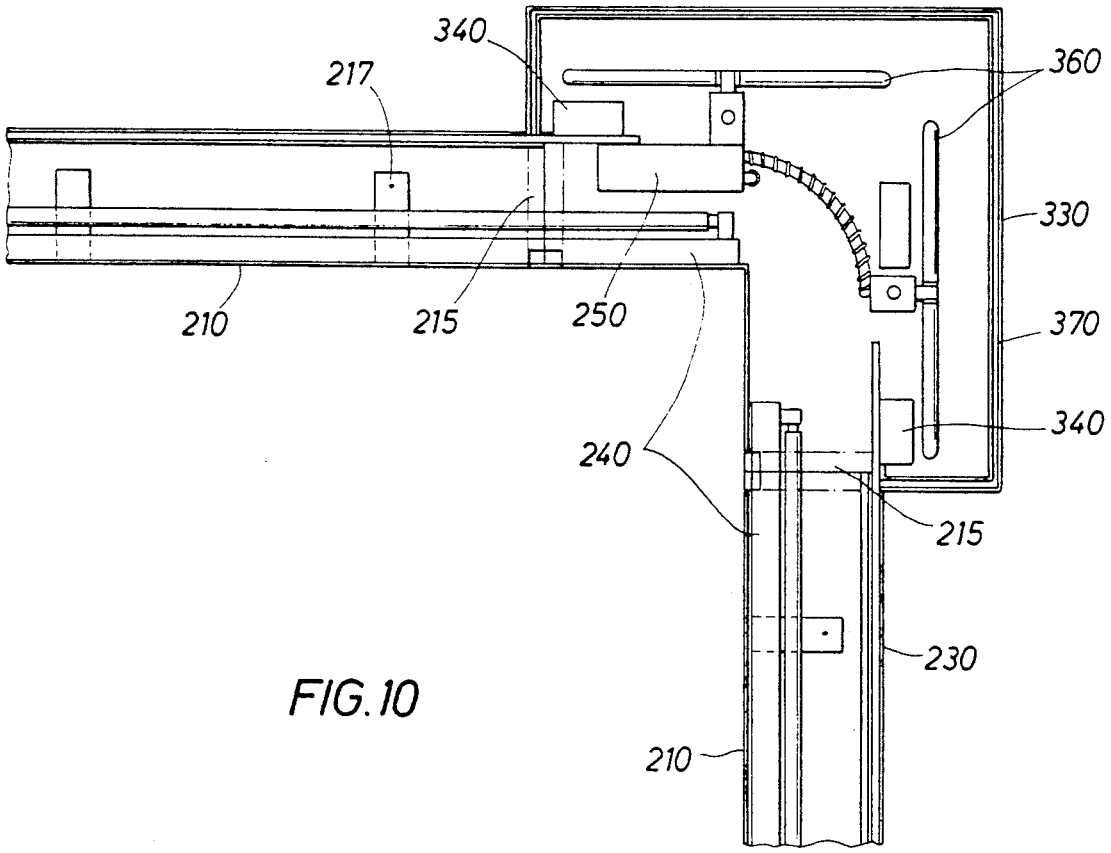
FIG. 10

LIGHTING SYSTEM

FIELD OF THE INVENTION

The invention relates to a lighting system for attachment to a roof, roof line, wall, or ceiling of a structure, or to a protective canopy structure.

BACKGROUND OF THE INVENTION

Canopies are used in gasoline service stations to cover the fuel pump area. This protects customers and employees from the weather as they pump gasoline and service the vehicle. Fluorescent or incandescent light fixtures may be provided in the ceiling of the canopy to provide partial lighting as needed. However it is also desirable to have peripheral lighting around the canopy. Desirable features of such lighting are continuous lighting, economical cost, ease of installation, ease of manufacture, and ease of maintenance. Accordingly, it would be advantageous to have such a lighting fixture available to provide peripheral lighting.

SUMMARY OF THE INVENTION

The invention relates to a lighting system for use with a raised roof or canopy. Raised canopies over gasoline service stations typically have down lighting for illuminating the work area beneath a canopy. The lighting system of the invention provides peripheral lighting for a canopy. By use of a series of light box side sections and corner sections a single lens may be used for each side to extend along substantially tile entire length of each side of a canopy. By use of a single lens for each side of the canopy and by overlapping the ends of the bulbs, an unbroken continuous light strip is provided with substantially no dark spots along each side. The corner sections are used to receive expansion of the lens due to thermal changes.

One aspect of the invention is a lens assembly for use in a lighting system including (a) an elongated translucent lens; (b) a track for slidably receiving the lens; (c) means for securing the lens at one point thereby allowing thermal expansion and contraction of the elongated translucent lens along the track; and (d) means for receiving ends of the elongated translucent lens during expansion and contraction.

Another aspect of the invention is a light box corner section attached to the corner of a raised canopy or roof including (a) a top assembly in an L-shaped configuration attached to the ceiling of the raised canopy the top assembly; (b) a bottom panel having an L-shaped configuration attached to the top assembly; and (c) a corner section elongated translucent lens secured between at least a portion of the outer edges of the top assembly and bottom panel.

BRIEF DESCRIPTION OF THE DRAWINGS

FIGS. 2 and 3 depict a portion of a side section in two embodiments.

FIG. 7 is an isometric view of one embodiment of a corner lens.

FIG. 8 depicts a portion of one embodiment of a side section.

FIG. 9 depicts a view of one embodiment of a side vertical view of the top assembly and bottom panel of the light box corner section.

FIG. 10 depicts a view of one embodiment showing the positioning of the elongated lenses in the mating of the corner section and side sections.

DETAILED DESCRIPTION OF THE INVENTION

A. Side Section

Figure 1:
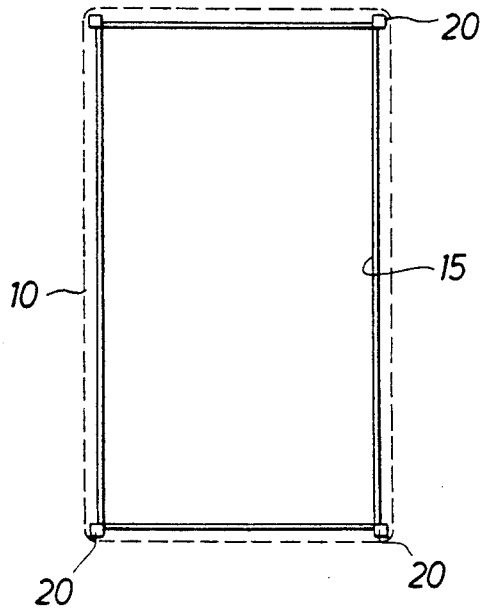
FIG. 1 is a view of one embodiment of the overall lighting system viewed from the bottom.

One embodiment of the elongated translucent lens of the invention is discussed below together with one embodiment of a structure containing tracks for slidably receiving the lens. In FIG. 1 under canopy 10, four light box side sections 15 and four light box corner sections 20 are interconnected to form a complete peripheral lighting system.

FIG. 2 shows the details of a section of light box side section 15 having top section 210 and bottom section 220. Top section 210 is an L-shaped configuration forming the top and back of the light box. The top and back in one embodiment form substantially a 90 degree angle. The width of the top is from about 2 inches to about 24 inches. The back is typically about the same height as the height of the elongated translucent lens 230 ("side section lens" or "elongated translucent lens of the light box side section") discussed below. The height of the back is from about 2 inches to about 62 inches. A suitable height is from about 3 inches to about 18 inches or from about 3 inches to about 10 inches. A bottom flange 223 is integrally formed from the rear edge of the of the bottom section 220. This bottom flange 223 is for connection of the bottom section 220 to the top section 210 optionally by horizontally oriented sheet metal screws through holes 219 in both the top and the bottom sections.

An L shaped or U shaped support bracket 217 is typically attached to the top section for additional support in attaching the bottom section. By adjusting the bolt used to attach the bottom section to the support bracket 217, any height fluctuation in the canopy ceiling can be overcome to make the bottom section level. This is useful so as to avoid binding when inserting the side section lens.

Both the top and bottom sections have light guards 215 attached to one end for preventing light from escaping other than through the side section lens 230. The side sections are connected end to end and the light guards permit the sections to overlap. Tracks 214 are attached to or optionally integrally formed on both the top and bottom sections. The tracks can be channels for receipt of the side section lens 230. Alternatively, the lens edges may have an integral slot on each edge which fits on a thin edged track. The top section optionally contains electric access holes 218. The top and bottom sections, including the tracks, are made of any durable, weather resistant material , such as metal, e.g., aluminum or steel, or plastic. The preferred material is carbon steel due to its strength and economical price.

The top section also optionally contains on its top portion spacing means 213. This may be in the form of a U-shaped strip of metal attached to the top of the top section. Through mounting holes 216 the top section is mounted beneath the canopy. The spacing means 213 is used where there is a downward directed lip on the edge of the canopy that would obscure the lighting system if it were not dropped downward beneath the bottom of the lip by the spacing means 213.

Electrical raceway 240 contains ballast 250 and sockets 245. It is covered by electrical raceway cover 260. The electrical raceway and cover are mounted against the back of the top section 210 optionally by mounting brackets 270. Where mounting brackets 270 are used they are held in place by typical fasteners such as bolts and nuts, including wing nuts, sheet metal screws, or machine bolts, etc. through the top portion of the top section 210, optionally used with washers. Either fluorescent or neon lighting is used to provide a continuous strip of light. Neon lighting requires one or more transformers. Fluorescent lights are typically used for their cost efficiency. Fluorescent bulb 280 is connected to sockets 245. The side section lens 230 is slidable through the tracks 214.

The side section lens 230 can be made of any of a variety of plastics. For example, in one embodiment polycarbonate or acrylic can be used in the form of a plastic sheet. If desired the plastic can be pigmented. The side section lens is from about 2 inches to about 60 inches in height and is typically from about 2 inches to about 18 inches in height.

Where the lens exceeds about 18 inches in height it can bow under its own weight if not supported at the top. Therefore at heights above about 18 inches the lens is supported at the top. This is done, for example, by using set screws placed periodically through the back of the upper track. The set screws go through slots in the lens cut near the top of the lens. Another method is periodically placing pressure resistant friction clips in the upper track. The top of the lens is then held in place by these clips.

The side section lens is from about 1/32 inches to about 3/16 inches in thickness and from about 10 feet to about 220 feet in length. The lens typically is fixedly secured at one point substantially at the center of each of the light strip side sections to permit thermal expansion and contraction outwardly from the center equally in each direction.

Figure 3:
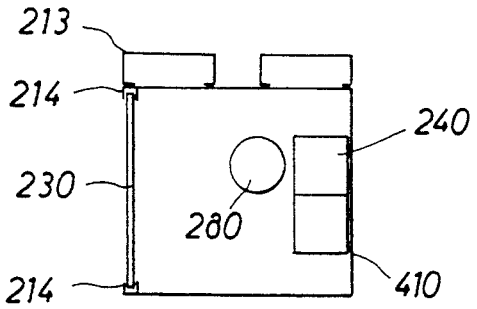

FIGS. 3 and 8 depict alternate embodiments of the side section. The embodiment in FIG. 3 is a variation on the embodiment in FIG. 2. In FIG. 3, instead of an L-shaped top section and separate bottom section the top and bottom are made from a single piece of material in the form of elongated C-shaped members 410. They will have a top flange, a bottom flange, and a vertical interconnecting portion connecting the top and bottom flanges at the inner edges thereof. All of the electrical lighting arrangements and lens details are the same as discussed above in regard to the embodiment in FIG. 2.

In the embodiment in FIG. 8 the lens 830 is U or C shaped and the back section 810 to which the lights are connected is substantially flat. Back section 810 has tracks 814 for slidably receiving lens 830. The fluorescent lighting and ballast are arranged similarly as in the embodiments in FIG. 2.

Figure 4:
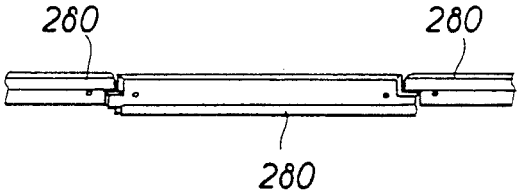
FIG. 4 is frontal view of one embodiment of a side section showing the light bulb arrangement.

FIG. 4 depicts the overlapping arrangement of fluorescent lights 280. The overlap should be an amount sufficient to maintain a continuous line of light through the lens even when the lights begin to darken at their ends due to aging. This overlap is typically from about 1 inches to about 3 inches.

B. Corner Section

A corner section is another aspect of the invention. The embodiment of a corner section discussed below is also a specific embodiment of the means element for receiving the ends of the side section lens 230 during thermal expansion and contraction. The use of the corner section permits the side section lens of the side section to lengthen and shorten due to thermal expansion and yet still maintain a continuous strip of illuminated lens. This is accomplished by adapting the corner piece so that the ends of the lens of the side section slide into the corner section out of sight.

Figure 5:
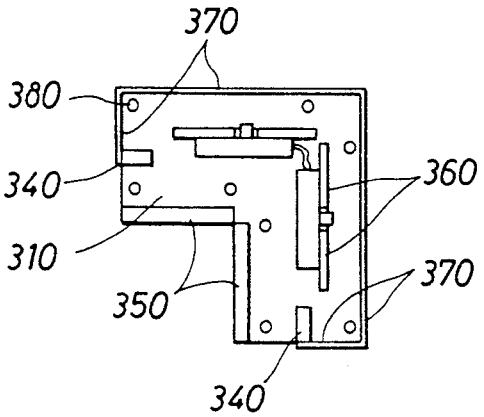
FIG. 5 is a bottom view of one embodiment of the top assembly of a corner section.
Figure 6:
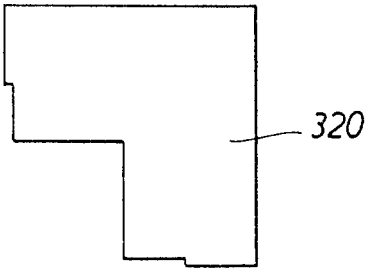
FIG. 6 is a top view of one embodiment of the bottom panel of a corner section.

FIGS. 5 and 6 show the top assembly and bottom panel of the corner section 20. The light box corner section has three main parts: a top assembly 310 having integral tracks 370, a bottom panel 320, and a corner section elongated translucent lens 330 ("corner section lens"). Top assembly 310 is in an L-shaped configuration attached to the ceiling of the raised canopy by, e.g., screw or bolt through mounting holes 380. Bottom panel 320 has an L-shaped configuration and is attached to the top assembly by any conventional attachment means such as vertical standoff brackets 340 which are attached to top assembly 310. Other conventional means for attaching the bottom panel to the top assembly include bolting threw a spacer tube or welding.

The top assembly and bottom panel are typically made of the same material as the top and bottom sections of the side section 15 described above. The dimensions of the top assembly and bottom panel should be proportional to the dimensions of the side section 15. For example, when the width/height of the side section is from about 5 inches to about 8 inches, then the length of the two outer edges of the L-shaped corner section is from about 20 inches to about 40 inches. The depth of the two sides would be from about 10 inches to about 20 inches.

The corner section lens 330, depicted in FIG. 7, is secured between at least a portion of the outer edges of the top assembly and bottom panel. The corner section lens 330 can be made of the same material and have the same height and thickness dimensions as the side section lens 230 described above. The length will be from about 1 feet to about 6 feet. The top assembly and bottom panel have tracks around a portion of their perimeter for receipt of the corner section lens. These tracks can be constructed as discussed above regarding the tracks of the side sections.

The corner section typically has a vertical flange 350 extending downwardly from each of the two inner edges of the L-configured top assembly 310. These vertical flanges are aligned with the back portion of the side sections when the side and corner sections are joined. Each vertical flange 350 together with one of the vertical standoff brackets 340 define the width of an opening adapted to receive the end of the light box side section 15. As mentioned above, the top section 210 and bottom section 220 of the side section typically will line up with top assembly 310 and bottom panel 320 of the corner section. The back portion of the top section 210 of the side section will typically align with the vertical flange 350 of the top assembly 310 of the corner section.

The side section lens 230 of the side section will typically align just behind the vertical standoff bracket 340. The side section lens 230 is free to lengthen and shorten into or out of the corner section due to thermal expansion and contraction. It is necessary to know the expansion and contraction characteristics of the material used for the side section lens 230 and the temperature ranges to which the lens will be exposed. With this information it is known to one skilled in the art how to determine how much excess lens length is needed during installation for extension into the corner section so that it will remain in the corner section during contraction.

For example, for a polycarbonate or acrylic lens the approximate expansion would be about three inches per 100 feet of lens where the temperature increases from about 70° F. to about 150° F. The approximate contraction would be about three inches per 100 feet of lens where the temperature decreases from about 70° F. to about −20° F. Due to the much shorter length of the corner section lens 330 of the corner section there is no need to provide for its thermal expansion and contraction.

The light box corner section has at least one and typically from two to four fluorescent lights 360 for illuminating through the corner section lens. These lights are typically attached to the top assembly 310. The lights are positioned between the vertical standoff brackets 340 and the corner section lens 330. The lights 360 must be in front of the vertical standoff brackets and in front of any end piece of side section lens 230 so that the side section lens and standoff brackets do not interfere with the lights 360 from illuminating the corner section lens 330. With this arrangement both the side section and corner section lenses are continuously illuminated.

The corner section lens is formed along its width at three places thereby permitting the corner section lens to be bent around the outer three corners of the L-shaped configuration of the top assembly and bottom panel. The forming may be by any conventional means such as heat forming. With this arrangement each end of the corner section lens will abut a portion of the side section lens where it enters the corner section. This permits the appearance of a continuous line of light.

C. Assembly

The following describes one method of assembling the lighting system of the invention. However, the described order of assembly is not critical and should not be construed as limiting. The top assembly of the corner sections are optionally first attached to the canopy. Where the two part side sections of FIG. 2 are used, the L-shaped top section is then attached to the canopy. The L-shaped top sections are typically in lengths sufficient to allow one person to lift and install them. Lengths of from about 2 feet to 9 feet are typical for this purpose. A number of the L-shaped top sections are joined end to end sufficient to go along one side of the canopy, from one corner section to another. Depending on the length of each side of the canopy it may be necessary to make one L-shaped top section shorter than the others in order to extend the length of the side from corner section to corner section.

The electrical raceway and sockets are then mounted to the back of the L-shaped top sections. The bottom sections are then attached to the back of the L-shaped top sections. After the bottom sections are attached the fluorescent bulbs are installed in the side sections. Then the side section lens is slid through the tracks along the entire length of the series of side sections. Next the fluorescent light bulbs are placed in the corner sections and the corner section lens is held up against the top assembly of the corner section while the bottom panel of the corner section is attached.

The bottom sections of the side sections are removed as necessary to replace bulbs or ballasts when they need changing. Similarly, the bulbs or ballasts of the corner sections are accessed by removing the bottom panel of the corner section. Since there are multiple bottom sections to the side section, it is not necessary to remove the side section lens when replacing bulbs or ballasts. The side section lens will be held in place by adjacent side sections even when one bottom section is removed.

What is claimed is:

1. A lens assembly for use in a lighting system comprising:

(a) a single elongated translucent lens.;

(b) tracks for slidably receiving said lens;

(c) means for securing said lens at one point thereby allowing thermal expansion and contraction of said elongated translucent lens along said tracks; and (d) means at opposite ends of said single elongated translucent lens including lens extending about a corner for slidably receiving opposite ends of said elongated translucent lens during expansion and contraction.

2. The lens assembly of claim 1 wherein said lens assembly is attached to a canopy and wherein said elongated translucent lens extends along substantially the entire length of a side of the canopy.

3. The lens assembly of claim 1 wherein said elongated translucent lens is pigmented acrylic.

4. The lens assembly of claim 3 wherein said elongated translucent lens is from about 2 inches to about 18 inches in height and from about 1/32 inches to about 3/16 inches in thickness and from about 10 feet to about 220 feet in length.

5. The lens assembly of claim 1 wherein said tracks are metal.

6. The lens assembly of claim 5 wherein said tracks are carbon steel.

7. The lens assembly of claim 1 wherein said elongated translucent lens is illuminated from behind by fluorescent lights.

8. A lens assembly for use in a lighting system comprising:

(a) a single pigmented acrylic elongated translucent lens from about 2 inches to about 18 inches in height and from about 1/32 inches to about 3/16 inches in thickness and from about 10 feet to about 220 feet in length;

(b) carbon steel tracks for slidably receiving said lens and wherein said lens is slidably secured in said tracks;

(c) means for securing said lens at one point thereby allowing thermal expansion and contraction of said elongated translucent lens along said tracks; and (d) corner sections for receiving both ends of said elongated translucent lens during expansion and contraction comprising:

(1) a top assembly in an L-shaped configuration attached to a ceiling of a raised canopy;

(2) a bottom panel having an L-shaped configuration attached to the top assembly; and (3) a corner section elongated translucent lens secured between at least a portion of outer edges of said top assembly and bottom panel.

9. A light box corner section attached to the corner section attached to the corner of a raised canopy or roof, said light box corner section comprising:

(a) a top assembly in an L-shaped configuration attached to a ceiling of the raised canopy;

(b) a bottom panel having an L-shaped configuration attached to the top assembly; and (c) a corner section elongated translucent lens secured between at least a portion of the outer edges of said top assembly and bottom panel.

10. The light box corner section of claim 9 further comprising a vertical flange extending downwardly from each of the two inner edges of the L-shaped configured top assembly.

11. The light box corner section of claim 9 further comprising attachment means attached to said top assembly for attaching said bottom panel to said top assembly.

12. The light box corner section of claim 9 further comprising a fluorescent light attached to the top assembly for illuminating through the corner section elongated translucent lens.

13. The light box corner section of claim 9 wherein said corner section elongated translucent lens is pigmented acrylic.

14. The light box corner section of claim 13 wherein said corner section elongated translucent lens is from about 2 inches to about 18 inches in height and from about 1/32 inches to about 3/16 inches in thickness and from about 1 feet to about 6 feet in length.

15. The light box corner section of claim 14 wherein said corner section elongated translucent lens is heat formed along its width at three places thereby permitting the corner section elongated translucent lens to be bent around the outer three corners of the L-shaped configuration of the top assembly and bottom panel.

16. The light box corner section of claim 14 wherein said top assembly and bottom panel are metal.

17. The light box corner section of claim 16 wherein said top assembly and bottom panel are carbon steel.

18. The light box corner section of claim 14 wherein said top assembly and bottom panel have integral channel tracks around at least a portion of their perimeter for receipt of said corner section elongated translucent lens.

19. A light box corner section attached to the corner of a raised canopy or roof, said light box corner section comprising:

(a) a carbon steel top assembly in an L-shaped configuration attached to a ceiling of the raised canopy, said top assembly having at least two vertical standoff brackets attached thereto, and having a vertical flange extending downwardly from each of the two inner edges of said L-configured top assembly; wherein said vertical flange and one of said vertical brackets define the width of an opening adapted to receive the end of a light box side section and for receipt of an end portion of an elongated translucent lens of said light box side section whereby said elongated translucent lens of said light box side section is free to lengthen and shorten into or out of said corner section due to thermal expansion and contraction; and having integral channel tracks around at least a portion of its perimeter for receipt of a corner section elongated translucent lens of part (c);

(b) a carbon steel bottom panel having an L-shaped configuration attached to the top assembly by said vertical brackets and having integral channel tracks around at least a portion of its perimeter for receipt of a corner section elongated translucent lens of part (c);

(c) a pigmented acrylic corner section elongated translucent lens secured in the integral channel tracks of said top assembly and bottom panel and being from about 2 inches to about 18 inches in height and from about 1/32 inches to about 3/16 inches in thickness and from about 1 foot to about 6 feet in length; and wherein said corner section elongated translucent lens is heat formed along its width at three places thereby permitting it to be bent around three outer corners of the L-shaped configuration of the top assembly and bottom panel; and (d) a fluorescent light attached to the top assembly for illuminating through said corner section elongated translucent lens.

* * * * *